US006924435B2

(12) United States Patent
Jow et al.

(10) Patent No.: US 6,924,435 B2
(45) **Date of Patent: *Aug. 2, 2005**

(54) HIGH-VOLTAGE DIRECT CURRENT CABLE INSULATION AND SEMICONDUCTIVE SHIELD

(75) Inventors: Jinder Jow, Somerville, NJ (US); Alfred Mendelsohn, Brooklyn, NY (US)

(73) Assignee: Union Carbide Chemicals & Plastics Technology, Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/663,525

(22) Filed: Sep. 16, 2003

(65) Prior Publication Data

US 2004/0112618 A1 Jun. 17, 2004

Related U.S. Application Data

(63) Continuation-in-part of application No. 10/263,328, filed on Oct. 7, 2002, now Pat. No. 6,670,554.

(51) Int. Cl.[7] ..... H01B 3/00
(52) U.S. Cl. ..... 174/110 R
(58) Field of Search ..... 174/110 R, 102 SC, 174/105 SC, 120 SR, 110 SR, 110 PM; 252/511, 512, 513; 428/522; 525/291

(56) References Cited

U.S. PATENT DOCUMENTS

| | | |
|---|---|---|
| 5,237,014 A | 8/1993 | Barnabeo |
| 6,106,742 A | 8/2000 | Argyropoulos et al. |
| 6,670,554 B1 * | 12/2003 | Jow et al. ..... 174/110 R |

FOREIGN PATENT DOCUMENTS

| | | |
|---|---|---|
| JP | 7065633 | 3/1995 |
| JP | 9231839 | 9/1997 |
| WO | 99/20685 | 4/1999 |
| WO | 99/23145 | 5/1999 |
| WO | 99/33066 | 7/1999 |
| WO | 99/33067 | 7/1999 |
| WO | 99/33068 | 7/1999 |
| WO | 99/33069 | 7/1999 |
| WO | 99/40589 | 8/1999 |
| WO | 99/44206 | 9/1999 |
| WO | 99/44207 | 9/1999 |

OTHER PUBLICATIONS

J. Tanaka, "*Interfacial Aging Phenomena In Power Cable Insulation systems*", Institute of Materials Science, University of Connecticut, Progress Report No. 8 and 9, Sep. 13, 1988.

(Continued)

*Primary Examiner*—Chau N. Nguyen

(57) ABSTRACT

A high-voltage direct current cable insulation is made from a blend which includes an ethylene copolymer, such as ethylene-alpha olefin copolymer, with low crystallinity to reduce physical space charge trapping sites, a polar polymer modifier in an effective amount to enhance local conductivity to leak space charge quickly when local stress is enhanced, and an ion scavenger to stabilize or neutralize the space charge to provide a composition which is an effective high-voltage DC cable insulation. A high-voltage direct current cable semiconductive shield is made from a blend that includes an ethylene copolymer, a carbon black having a low level of ionic species, a polar polymer modifier, and an ion scavenger.

9 Claims, 1 Drawing Sheet

OTHER PUBLICATIONS

Y. Li, M. Yasuda, and T. Takad, "*Pulsed Electro–acoustic Method for Measurement of Charge Accumulation in Solid Dielectrics,*" IEEE Transactions on Dielectrics and Electrical Insulation, vol. 1, pp. 188–195, 1994.

M. Salah Khalil, "*International Research and Development Trends and Problems of HVDC Cables with Polymeric Insulation,*" IEEE Electrical Insulation Magazine. vol. 13, No. 6, pp. 39–41, Nov./Dec. 1997.

G.C. Montanari and D. Fabiani, "*Evaluation of dc Insulation Performance Base on Space–Charge Measurments and Accelerated Life Tests, "* IEEE Transactions on Dielectrics and Electrical Insulation, vol. 7, No. 3, Jun. 2000.

M. Abou–Dakka, A. Bulinski, and S. Barmji, "*Space Charge Development in XLPE Insulation with and without Tree Retardant Subjected to DC Field,"* 2000 Conference on Electrical Insulation and Dielectric Phenomena.

* cited by examiner

HIGH-VOLTAGE DIRECT CURRENT CABLE INSULATION AND SEMICONDUCTIVE SHIELD

REFERENCE TO PATENT APPLICATION

This is a continuation-in-part of application Ser. No. 10/263,328 filed Oct. 7, 2002 now U.S. Pat. No. 6,670,554.

FIELD OF THE INVENTION

This invention is directed to insulation and a semiconductive shield for power cables. More particularly, this invention is directed to insulation and a semiconductive shield for high-voltage direct current power cables.

DESCRIPTION OF THE PRIOR ART

Direct Current (DC) power transmission has several advantages over alternating current (AC) power transmission. DC transmission does not have a length limit, permits long-distance submarine cables (>50 km), has good connectivity among different networks/sources (such as windmills), has lower operating costs due to low conductor loss and no power loss, has superior power quality and flow control for system reliability/stability, and has higher voltage ratings. Cables insulated with oil/paper insulation have been successfully used for high-voltage direct current (HVDC) applications since 1954. Cables insulated with crosslinked polyethylene can have several advantages over cables insulated with oil/paper for HVDC applications. The advantages of crosslinked polyethylene include lower manufacturing costs, lower operation costs, easier maintenance for utilities, higher temperature ratings (such as 90 degrees C. vs. 60 degrees C. to 70 degrees C.) to utilities, and environmental friendliness due to no oil leakage.

Polymeric dielectric insulating materials, particularly polyethylene without modification, however, cannot be used for HVDC applications. These materials have local space charge buildup, which can significantly enhance local fields under surge or lightning impulse, have charge neutralizations during reverse polarity, which can reduce local DC breakdown strength, and have stress inversions due to temperature-dependent conductivity, which can reverse local field enhancement.

A known approach to develop HVDC polymeric cable insulation products has been to have low and well-distributed space charge traps. Space charge can be trapped by physical traps formed between crystallinity and amorphous boundaries or chemical traps due to chemical structures of substances. The instant invention, however, is a cable insulation made from a blend which includes an ethylene copolymer, such as an ethylene-alpha olefin copolymer with low crystallinity to reduce physical space charge trapping sites. The invention uses at least one polar polymer modifier in an effective amount to enhance local conductivity to leak space charge quickly when local stress is enhanced, and at least one ion scavenger to stabilize or neutralize the space charge to provide a composition which is an effective high-voltage DC cable insulation. The instant invention is also a semiconductive shield made from a blend that includes an ethylene copolymer, a carbon black having low levels of ionic species, a polar polymer modifier, and an ion scavenger.

SUMMARY OF THE INVENTION

The invention is directed to (1) a direct current cable, which includes insulation, which resists breakdown and deterioration when exposed to high-voltage direct current, (2) an insulation composition which resists deterioration and breakdown when exposed to high-voltage direct current, and (3) a method for reducing the deterioration of such insulation. The invention is also directed to a semiconductive shield with similar resistance to breakdown and deterioration.

The cable insulation composition includes at least one crosslinked nonpolar, low crystallinity resin with a density of less than 0.900 grams/cubic centimeter which tends not to trap charge or create charge trap sites for a cable insulation temperature rating of at least 90 degrees C. In another aspect, the resin is not crosslinked or is crosslinked only in a low amount (hereinafter a non-crosslinked polymer) which is effective for providing a cable insulation with a temperature rating of 75 degrees C. or above. In either aspect, the cable insulation also includes (1) at least one polar polymeric modifier which dissipates or leaks charge quickly under high fields, (2) at least one ion scavenger which stabilizes or neutralizes space charges, and (3) optionally at least one heat stabilizer which minimizes internal charge generation during in service thermal degradation of insulation.

The crosslinked nonpolar low crystalline resin, polar polymeric modifier, ion scavenger and heat stabilizer are in amounts effective for achieving temperature rating of 90 degrees C. or above, a charge density less of than 2 Coulomb/mm$^3$ measured by a pulsed electro acoustic (PEA) method after 24 hours with either positive or negative 20 kV/mm applied. For the cable insulation which has a temperature rating of not more than 75 degrees C. the amount and extent of crosslinking of such resin, the amounts of polar polymeric modifier, ion scavenger and heat stabilizer all are effective for achieving temperature rating of 75 degrees C. or above, a charge density less of than 2 Coulomb/mm$^3$ measured by a pulsed electro acoustic (PEA) method after 24 hours with either positive or negative 20 kV/mm applied.

In another aspect, the invention is a high-voltage direct current cable insulation composition which has a temperature rating of 90 degrees C. or above and which comprises a blend of or which is made from a blend of at least one crosslinked ethylene copolymer, such as ethylene/alpha olefin copolymer, having a density of less than 0.900 grams/cubic centimeter, a melt index of from 0.5 to 10 grams/10 minutes, a crystallinity of less than about 10 percent; at least one polar polymeric modifier in an amount effective to provide field conductivity and permitting leakage of space and charge only at high fields; at least one ion scavenger in an amount effective to reduce charge build-up relative to a blend which does not include an ion scavenger; and, optionally, at least one heat stabilizer in an amount effective to prevent thermally induced degradation and resulting internal charge generation. The polar polymeric modifier, ion scavenger, and optional heat stabilizer are in amounts and ratios which when in combination with the crosslinked resin provide the insulation with a charge density less than 2 Coulomb/mm$^3$ measured by a PEA method after 24 hours with either positive or negative 20 kV/mm applied.

In another aspect, for cable insulation which has a temperature rating of 75 degrees C. or above, the cable insulation composition comprises a nonpolar, non-crosslinked ethylene copolymer, such as an ethylene/alpha olefin copolymer, having a density of less than 0.900 grams/cubic centimeter a melt index of from 0.5 to 10 grams/10 minutes, a crystallinity of less than about 10 percent; at least one polar polymeric modifier in an amount effective to provide field conductivity and permitting leakage of space and charge only at high fields; at least one ion scavenger in an amount effective to reduce charge build-up relative to a blend which does not include an ion scavenger; and, optionally, at least one heat stabilizer in an amount effective to prevent thermally induced degradation and resulting internal charge generation. The polar polymeric modifier, ion scavenger, and optional heat stabilizer are in amounts and ratios which when in combination with the resin provide the insulation with a charge density less than 2 Coulomb/$mm^3$ measured by a PEA method after 24 hours with either positive or negative 20 kV/mm applied.

In yet another aspect, the invention is a high-voltage direct current cable insulation which comprises a blend of or which is made from a blend of at least one crosslinked ethylene/butene or ethylene/hexene olefin polymer having a density of less than 0.900 grams/cubic centimeter, a melt index of from 0.5 to 10 grams/10 minutes; from 0.1 to 15 weight percent of at least one polar polymeric modifier; from 0.05 to 0.5 weight percent of at least one charge scavenger to reduce charge build-up, and optionally, from 0.1 to 5 weight percent of at least one heat stabilizer in an amount effective to prevent thermally induced degradation and resulting internal charge generation.

The semiconductive shield composition of the present invention includes (a) at least one nonpolar, low crystallinity resin with a density of less than 0.900 grams/cubic centimeter, (b) a carbon black having low levels of ionic species, (c) at least one polar polymeric modifier, and (d) at least one ion scavenger. Optionally, the composition can include at least one heat stabilizer. The resin can be crosslinked or not. The polar polymeric modifier dissipates or leaks charge quickly under high fields. The ion scavenger stabilizes or neutralizes space charges. The optional heat stabilizer minimizes internal charge generation during in service thermal degradation of insulation. The resulting cable should achieve either a temperature rating of (a) 90 degrees C. or above or (b) 75 degrees C. or above.

DESCRIPTION OF THE INVENTION

Figure 1:
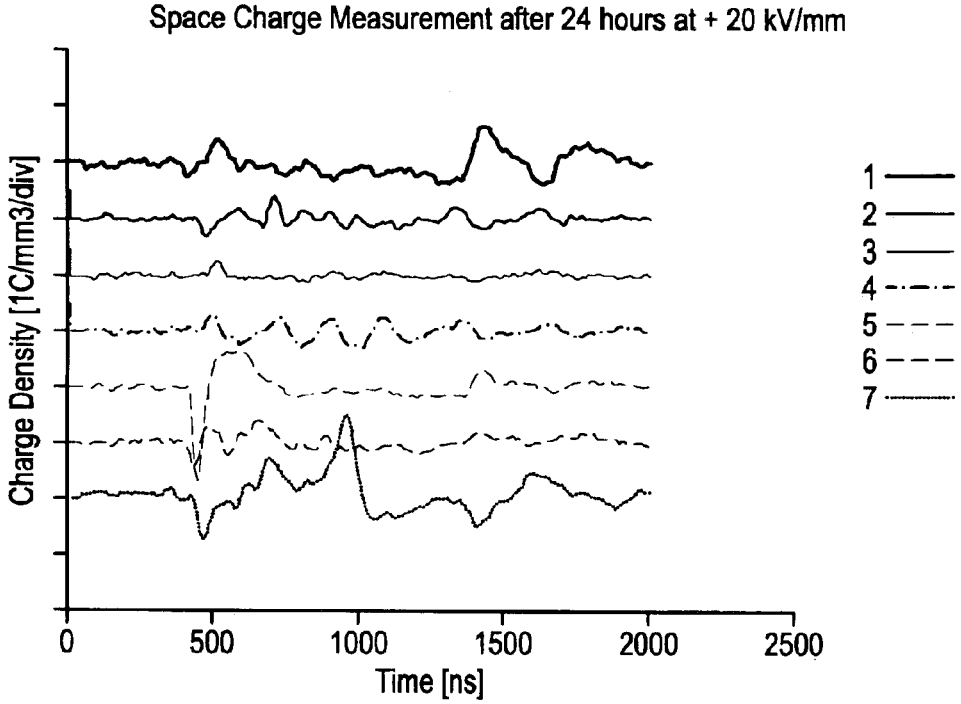
FIG. 1 describes PEA space charge measurements after 24 hours at +20 kV/mm.

The nonpolar ethylene copolymer, which can be used in the invention, includes ethylene/alpha olefin interpolymers, such as an ethylene/propylene copolymer. The resin has low crystallinity and has a density of less than 0.90 grams/cubic centimeter. In a very important aspect, the resin used in the invention is a $C_2$–$C_6$ alpha olefin copolymer. Low crystallinity means a crystallinity of less than 20 percent as determined by a differential scanning calorimeter. The alpha olefin resins, which may be used in the invention, include an ethylene-hexene copolymer made with a single site catalyst (SSC), an ethylene-butene copolymer made with a Ziegler Natta (Z/N) catalyst, and an ethylene-octene copolymer made with a SSC catalyst. The nonpolar ethylene copolymer may have some polar components, but such polar components should not be in such an amount to make the resin crystalline and loose its amorphous characteristics. Hence, the nonpolar resin may contain an ethylene/styrene copolymer, an ethylene vinyl acetate copolymer, or an ethylene/ethyl acrylate copolymer in low amounts. In the aspect of the invention, which includes a crosslinked resin, the resin may be crosslinked using a peroxide, irradiation or a moisture cure.

Polar polymer modifiers are polymeric materials having at least one polar component. These polar components may be a part of the polymer structure as side groups which group may be residues of maleic anhydride, vinyl acetate and vinyl acrylate, where such compounds have been incorporated into the polymer, such as by grafting or were a part of the monomer precursor of the polymer. Polar components also may include hydroxyl group, styrenic group and carboxyl group. The polar polymeric modifier may be polyethylene glycol (where the polar component is hydroxyl group), ethylene ethyl acrylate (where the polar component is a residue of vinyl acrylate), ethylene styrene copolymer (where the polar component is a styrenic group) or a polyester having an acid number (where the polar component is a carboxyl group). The polar polymer modifiers may include maleic-anhydride-grafted very low density ethylene/alpha olefin copolymers having a density of less than about 0.900 grams/cubic centimeter as described above having about 0.3 percent maleic anhydride, polycaprolactone resins (having a carboxyl group in the main chain with a diol group at the end) and mixtures thereof.

Ion scavengers are compounds that have chelating groups, such as hydroxyl and carboxyl. Ion scavengers may include 1,2-bis(3,5-di-tert-butyl-4-hydroxyhydrocinnamoyl) hydrazine, poly[[6-[1,1,3,3-tetramethylbutyl)amino]-s-triazine-2,4-diyl] [2,2,6,6-tetramethyl-4-piperidyl)imino] hexamethylene [(2,2,6,6-tetramethyl-4-piperidyl)imino], N,N'-bis(0-hydroxybenzal) oxalydihydride, barbituric acid, tertiary phosphorous acid ester of a thiobisphenol, and N,N'-diphenyuloxamid, and mixtures thereof.

Antioxidants also may be put into the insulation or semiconductive shield compositions. Antioxidants, which may be used, include: 1,3,5-tris(4-tert-butyl-3-hydroxy-2,6-dimethylbenzyl) -1,3,5-triazine-2,4,6-(1H, 3H, 5H)-trione, commercially available as Cyanox 1790; and distearylthiodipropionate (DSTDP).

For semiconductive shield compositions, the carbon black should have a low level of ionic species, preferably less than about 200 ppm. More preferably, the amount of ionic species is less than about 100 ppm. The amount of ionic species of a carbon black can be determined by Induction Coupling Plasma Spectroscopy or the method described in J. Tanaka, "Interfacial Aging Phenomena In Power Cable Insulation systems", Institute of Materials Science, University of Connecticut, Progress Report No. 8 and 9, Sep. 13, 1988.

For a crosslinked insulation composition with a temperature rating of 90 degrees C., its elongation and set at a temperature of 150 degrees C. per ICEA T-28-562 test method should not be greater than 175 percent and 10 percent, respectively. The alternative referee method is the solvent extraction test per ASTM D2765. The crosslinked insulation composition generally will have maximum extractables after 20 hours drying time of no more than 30 percent. Insulation with a temperature rating of 75 degrees C. generally requires having percent retained tensile strength and elongation at break of no less than 70 percent after heat aged at 113 degrees C. for 7 days in air-circulated over per UL-1581 standard.

EXAMPLES 1–7

Examples 1, 2, 3, 4 and 6 illustrate the invention. Examples 5 and 7 are comparative examples.

For each example, the base ethylene polymer was characterized as having low crystallinity and a low melt index and as being a very low density polyethylene: (a) Exact 4033™ ethylene/hexene copolymer; (b) DGH-8480™ ethylene/butene copolymer; or (c) Engage 8003™ ethylene/octene copolymer. Unless otherwise indicated in Table 1, the exemplified composition contained Exact 4033™ ethylene/hexene copolymer as the base polymer.

Exact 4033™ ethylene/hexene copolymer, having a density of 0.880 grams/cubic centimeter and a melt index of 0.8 grams/10 minutes, is a single-site catalyzed polyethylene available from Exxon Chemical Co. DGH-8480™ ethylene/butene copolymer, having a density of 0.884 grams/cubic centimeter and a melt index of 0.8 grams/10 minutes, is available from The Dow Chemical Company. Engage 8003™ ethylene/octene copolymer, having a density of 0.885 grams/cubic centimeter and a melt index of 1.0 grams/10 minutes, is a single-site catalyzed polyethylene available from DuPont Dow Elastomers LLC.

All of the exemplified compositions also contained 0.25 weight percent of Chimassorb 944 poly[[6-[1,1,3,3-tetramethyl-butyl)amino]-s-triazine-2,4-diyl] [2,2,6,6-tetramethyl-4-piperidyl)imino]hexamethylene[(2,2,6,6-tetramethyl-4-piperidyl)imino]] as an ion scavenger, 0.14 weight percent of Cyanox 1790 1,3,5-tris(4-tert-butyl-3-hydroxy-2,6-dimethylbenzyl)-1,3,5-triazine-2,4,6-(1H, 3H, 5H)-trione as a primary antioxidant, and 0.23 weight percent of DSTDP as a secondary antioxidant. Chimassorb 994 is available from Ciba Specialty Chemicals Corporation. Cyanox 1790 is available from Cytec Corporation. DSTDP is available from Great Lakes Corporation.

Also, each composition was cured with bis(1-methyl-1-phenylethyl) peroxide, which is available from Hercules Corporation.

Various other components were used in the exemplified composition. DEFA-1373™ very low density ethylene/butene copolymer, having a 0.3 weight percent maleic anhydride graft, is available from The Dow Chemical Company and characterized as a polar polymer modifier. DEFA-1373 has a density of 0.903 grams/cubic centimeter and a melt index of 2.0 grams/10 minutes. Tone Polymer P-767™ polylactone resin has a density of 1.145 grams/cubic centimeter, a melt index of 30.0 grams/10 minutes, and melting point of 60 degrees C. P-767 polylactone resin is available from The Dow Chemical Company and characterized as a polar polymer modifier. Zinc oxide, which was added as a heat stabilizer/phonon dissipator, is available as Kadox 911P from Zinc Corporation of America. Irganox 1024 1,2-bis(3,5-di-tert-butyl -4-hydroxyhydrocinnamoyl) hydrazine, which was added as an ion scavenger, is available from Ciba Specialty Chemicals Corporation.

The space charge measurements were performed by a pulsed electro acoustic method. The details of this method can be found in literature as described in Y. Li, M. Yasuda, and T. Takad, "*Pulsed Electro-acoustic Method for Measurement of Charge Accumulation in Solid Dielectrics,*" IEEE Transaction EI, Vol. 1, pp. 188–195, 1994.

Figure 2:
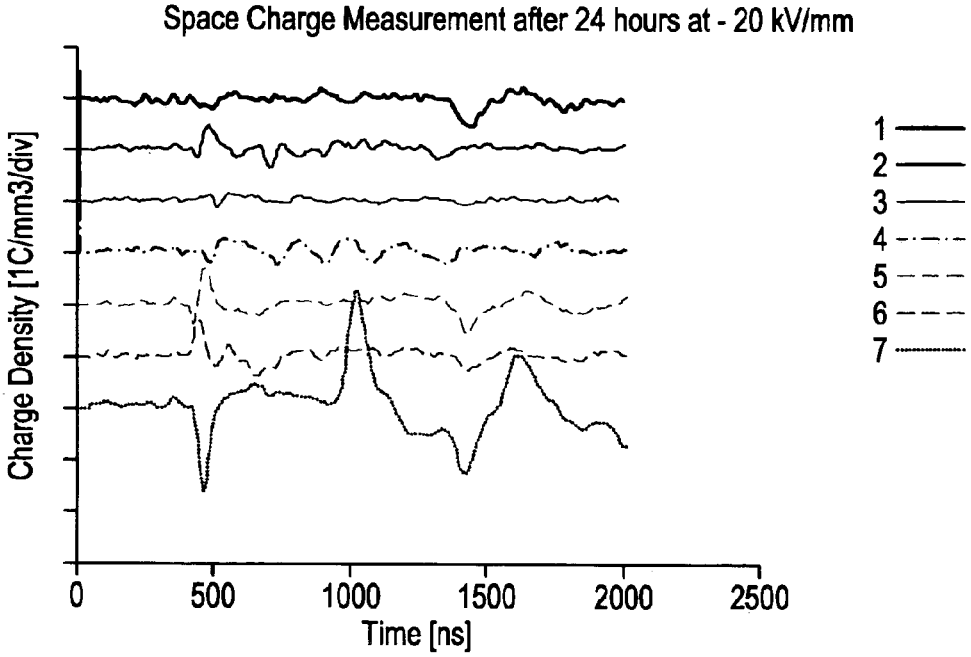
FIG. 2 describes PEA space charge measurements after 24 hours at −20 kV/mm.

Each sample had 1.6 mm thickness with a diameter of 135 mm, placed between semicon electrodes of 0.1 mm and a diameter of 30 mm, placed between semicon electrodes of 0.1 mm and diameter of 30 mm. The application of 32 kV DC (20 kV/mm) was applied for 24 hours, and space charge was measured by PEA without voltage applied as shown in FIG. 1. The sample was grounded without applied voltage for 12 hours, and then voltage was applied with −32 kV DC (20 kV/mm) for 24 hours. The space charge without voltage applied was measured again by the PEA as shown in FIG. 2. All measurements were done at ambient temperature about 20 degrees C. Space charge measurements were plotted as charge density (Coulomb per cubic millimeter) as a function of time (nano-second). Each division shown in FIGS. 1 and 2 is equivalent to a value of 2 Coulomb/mm$^3$.

For HVDC cable applications, HVDC cable insulation should keep the space charge as low as possible and as uniform as possible throughout the measurement of time. The value of space charge measurement for excellent HVDC cable insulation should be no more than 2 Coulomb/mm$^3$ for both positive and negative DC stress.

TABLE I

| | HVDC INSULATION | | | | | | |
|---|---|---|---|---|---|---|---|
| Component | Ex. 1 | Ex. 2 | Ex. 3 | Ex. 4 | C. Ex. 5 | Ex. 6 | C. Ex. 7 |
| base ethylene polymer | 89.28 | 97.28 | 95.28 | 85.28 | 99.38 | 97.28[1] | 97.28[2] |
| maleic anhydride-grafted polyethylene | 10.00 | | | 10.00 | | | |
| polylactone resin | | 2.00 | 2.00 | 2.00 | | 2.00 | 2.00 |
| zinc oxide | | | 2.00 | 2.00 | | | |
| Irganox 1024 | 0.10 | 0.10 | 0.10 | 0.10 | | 0.10 | 0.10 |
| Weight percent ratio of thermoplastics to curing agent | 99.2:0.8 | 99.2:0.8 | 99.2:0.8 | 99.2:0.8 | 99.2:0.8 | 99.0:1.0 | 99.0:1.0 |

[1]DGH-8480 ™ ethylene/butene copolymer.
[2]Engage 8003 ™ ethylene/octene copolymer.

Effect of Additives

Comparative Example 5 containing typical antioxidants and UV stabilizer did not meet the desired requirement on space charge value at the applied positive DC stress of 20 kV/mm. However, Examples 1 and 2 with Irganox 1024 and two different polar polymer modifiers, respectively, met the desired requirements at both positive and negative DC stresses. Example 2 showed lower space charge distribution than Example 1. Example 3 with additional heat stabilizer, zinc oxide, showed further improvement in space charge when compared with Example 2. Example 4 with the combination of additive packages from Example 3 and 1 showed acceptable space charge performance.

Effect of the Resins

Examples 2 and 6 and Comparative Example 7 showed the effect of various VLDPE resins on space charge distribution. Comparative Example 7 made by octene comonomer did not meet the space charge distribution criteria with the levels of polymer modifier and ion scavenger shown.

What is claimed is:

1. High-voltage direct current cable semiconductive shield comprising: a blend of or which is made from a blend of (a) at least one ethylene copolymer having a density of less than about 0.900 grams/cubic centimeter, a melt index of from about 0.5 to about 10 grams/10 minutes, a crystallinity of less than about 10 percent and a catalyst residue of less than about 1000 ppm;

(b) a carbon black having a low level of ionic species;

(c) at least one polar polymer modifier in an amount effective to provide a semiconductive shield made with the blend with an enhanced field conductivity and enhanced space charge leakage at high fields relative to a semiconductive shield made with a blend which does not include a polar polymer modifier; and (d) at least one ion scavenger in an amount effective to reduce ionic mobility relative to a semiconductive shield made with a blend, which does not include an ion scavenger.

2. A high-voltage direct current cable semiconductive shield according to claim 1, wherein the ethylene copolymer is selected from the group consisting of (a) ethylene/alpha olefin copolymers and (b) nonpolar, low crystalline ethylene copolymers selected from the group consisting of ethylene/propylene copolymer and ethylene/styrene copolymer and mixtures thereof.

3. The high-voltage direct current semiconductive shield of claims 1 or 2, wherein the blend further includes at least one heat stabilizer.

4. The high-voltage direct current semiconductive shield of claim 3, wherein (a) the polar polymer modifier is selected from the group consisting of (i) a polymer having a density of less than 0.900 grams/cubic centimeter with at least one side group selected from the group consisting of hydroxyl, carboxyl, styrenic; (ii) a polymer having a density of less than 0.900 grams/cubic centimeter and at least one side group which is a residue of maleic anhydride, vinyl acetate or vinyl acrylate; (iii) a polylactone resin and; (iv) mixtures thereof, and (b) the ion scavenger has at least one chelating group.

5. The high-voltage direct current semiconductive shield of claim 3, wherein the ethylene copolymer is crosslinked.

6. The high-voltage direct current semiconductive shield of any of claims 1 or 2, wherein (a) the polar polymer modifier is selected from the group consisting of (i) a polymer having a density of less than 0.900 grams/cubic centimeter with at least one side group selected from the group consisting of hydroxyl, carboxyl, styrenic; (ii) a polymer having a density of less than 0.900 grams/cubic centimeter and at least one side group which is a residue of maleic anhydride, vinyl acetate or vinyl acrylate; (iii) a polylactone resin and; (iv) mixtures thereof, and (b) the ion scavenger has at least one chelating group.

7. The high-voltage direct current semiconductive shield as recited in claim 6, wherein the ion scavenger is selected from the group consisting of 1,2-bis(3,5-di-tert-butyl-4-hydroxyhydrocinnamoyl)hydrazine, poly[[6-[1,1,3,3-tetramethylbutyl)amino]-s-triazine-2,4-diyl] [2,2,6,6-tetramethyl-4-piperidyl)imino]hexamethylene[(2,2,6,6-tetramethyl-4-piperidyl)imino]] N,N'-bis(0-hydroxybenzal) oxalydihydride, barbituric acid, tertiary phosphorous acid ester of a thiobisphenol, and N,N'-diphenyuloxamid, and mixtures thereof.

8. The high-voltage direct current semiconductive shield of claim 6, wherein the ethylene copolymer is crosslinked.

9. The high-voltage direct current semiconductive shield of any one of claims 1, 2, or 7, wherein the ethylene copolymer is crosslinked.

* * * * *